US005787611A

United States Patent [19]

Bonaventure

[11] Patent Number: 5,787,611

[45] Date of Patent: Aug. 4, 1998

[54] TWO-PART SKI BOOT

[75] Inventor: Laurent Bonaventure, Cran-Gevrier, France

[73] Assignee: Salomon S.A., Metz-Tessy, France

[21] Appl. No.: 678,509

[22] Filed: Jul. 9, 1996

[30] Foreign Application Priority Data

Sep. 6, 1995 [FR] France ..... 95 10584

[51] Int. Cl.[6] ..... A43B 5/04

[52] U.S. Cl. ..... 36/117.1; 36/118.8; 36/119.1

[58] Field of Search ..... 36/117.1, 118.2, 36/118.8, 119.1

[56] References Cited

U.S. PATENT DOCUMENTS

| | | | |
|---|---|---|---|
| 3,530,594 | 9/1970 | Vogel | 36/117.1 |
| 3,597,862 | 8/1971 | Vogel | 36/117.1 |
| 3,718,994 | 3/1973 | Spier | 36/117.1 |
| 5,365,679 | 11/1994 | Chemello | 36/117 |
| 5,381,611 | 1/1995 | Tonel et al. | 36/117.1 |
| 5,410,822 | 5/1995 | Vaccari | 36/117.1 |
| 5,499,461 | 3/1996 | Danezin et al. | 36/117.1 |
| 5,548,909 | 8/1996 | Foffano et al. | 36/117.1 |

FOREIGN PATENT DOCUMENTS

| | | |
|---|---|---|
| 0572775 | 12/1993 | European Pat. Off. . |
| 0572862 | 12/1993 | European Pat. Off. . |
| 0619958 | 10/1994 | European Pat. Off. . |
| 2022109 | 7/1970 | France . |
| 2691884 | 12/1993 | France . |
| 01247070 | 12/1994 | Italy . |
| 91000018 | 3/1995 | Italy . |

*Primary Examiner*—M. D. Patterson
*Attorney, Agent, or Firm*—Greenblum & Bernstein, P.L.C.

[57] ABSTRACT

An alpine ski boot having a shell base provided with an external sole topped by an upper that is provided with a central and/or anterior opening for the passage of the skier's foot and which forms, at its upper portion, a collar adapted to encircle the lower part of the leg with at least one tensioning member positioned on transverse flaps. The boot is composed of two main parts that are constituted, on the one hand, by the shell base having a longitudinal opening at its upper portion and made of a relatively rigid material and, on the other hand, by a single opening-closing element attached and fixed on a periphery of the upper longitudinal opening of the shell base, this element itself having, all in one piece, a first substantially vertical portion forming the upper, and a substantially horizontal second portion obtained in the extension of the first and forming an upper cuff for holding the foot, the assembly thus formed being obtained in a relatively less rigid material than that of the shell base.

21 Claims, 2 Drawing Sheets

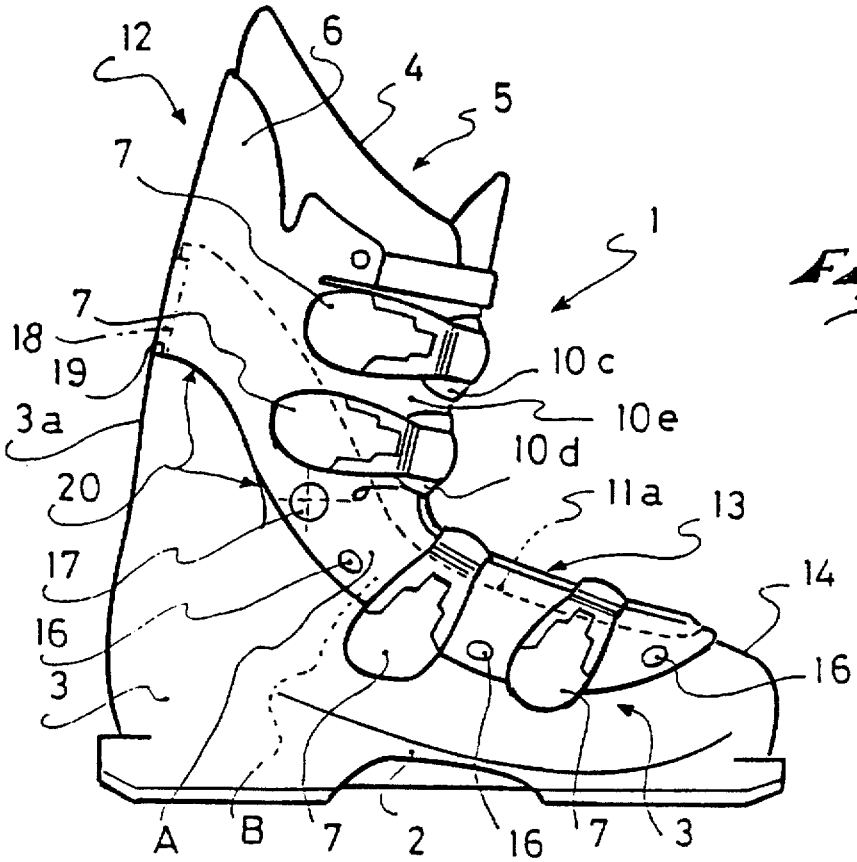
Fig. 1
Fig. 2
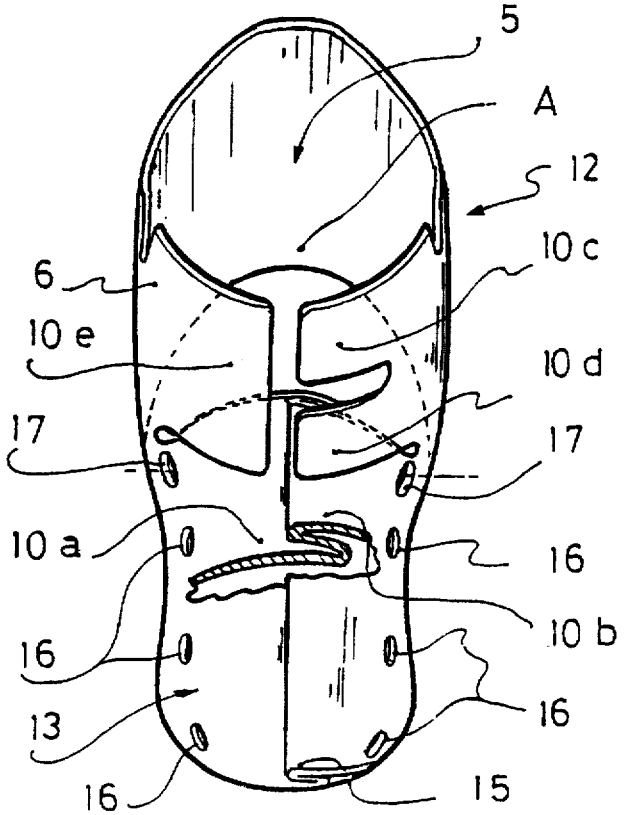

TWO-PART SKI BOOT

BACKGROUND OF THE INVENTION

1. Field of the Invention

The present invention relates to an alpine ski boot that has a shell base provided with an external sole and topped by an upper, the latter being provided with a central and/or anterior opening for the passage of the skier's foot and forming, at its upper portion, a collar adapted to encircle the lower part of the leg by means of at least one tensioning member positioned on transverse flaps obtained on both sides of the opening of the upper and cooperating by mutual overlapping, during closure, under the effect of the tensioning member.

2. Background and Material Information

In this type of boot, the problems commonly encountered are related to the search for a compromise between a shell base having qualities of torsional strength, for a good operation of the ski, due to rear support and to lateral support, and an upper taking advantage of the sufficiently flexible portions that are suitable, i.e., that make it possible to adapt to the individual aspects of the skier's foot morphology.

The construction of a boot of this type is taught in the French Patent Publication No. 2022109. Its structure has a rigid shell base provided with an external sole, an upper rigidly fixed thereon that forms, at its upper portion, a collar adapted to encircle the lower part of the leg by means of a tensioning member and of elastically extensible portions. These portions are arranged at the front and rear of the upper in order to also allow for and facilitate the passage of the foot when putting on and taking off the boot. A front upper closure cuff constitutes a portion that is suited for the top of the foot, and flexion control means, for example, an elastic band provided with a spring, are associated with the upper.

Such a boot has the following disadvantages:

- very complicated because it requires numerous, in fact, at least four components;
- not easy to put on and take off because it is required that the flexion control means and the tensioning member be released first;
- imprecise adjustment on the foot because it uses extensible means to cover the portions of the top of the foot, of the lower part of the leg and of the heel, the tensioning member that partially covers these means being prone to causing localized, therefore painful, pressure zones;
- not very functional because the upper cannot pivot in relation to the shell base;
- lack of imperviousness because large portions for covering and enveloping the foot are textile linings, and have numerous joints.

This latter disadvantage tends to be resolved by the commonly owned French Patent Publication No. 2691884. According to this patent, the ski boot has a shell base provided with an external sole and topped by an upper provided with a central and anterior opening for the passage of the skier's foot; this upper forms, at its upper portion, a collar adapted to encircle the lower part of the leg by means of at least one tensioning member arranged on transverse flaps obtained on both sides of the opening of the upper and adapted to cooperate by mutual overlapping, during closure, under the effect of the tensioning member. The solution to solve the problem related to the imperviousness of the transverse flaps, i.e., the overlapping portions, consists of attaching an impervious flexible covering means on the exterior of the boot to envelop the two flaps by closing the interstice existing therebetween in the position for closing the boot.

This type of construction provides a satisfactory result but is complex and expensive, because it requires a sealing means to be attached on the flaps and does not simplify the design of the shell base and of the upper. The walls of the shell base and of the upper must be thinner in the area of the flaps to facilitate the spacing thereof when putting on and taking off the boot, as well as their adaptation on the top of the foot and around the lower part of the leg during closure of the boot.

In fact, it has always been desired for a boot to be able to be put on easily by presenting a zone for inserting the foot, that is large, easy of access and capable of adapting to the foot to be held and/or tightened.

The Italian Patent Application No. VI 91 000018 proposes a boot that offers these qualities, due to the provision of flexible flaps that are then attached on a rigid shell base, on both sides of an anterior opening with which it is provided, and which is dimensioned to allow for the passage of the foot. Such a construction proves complex to manufacture because it requires numerous elements that must be assembled and adjusted on the shell base and does not simplify the structure of the upper in the zone corresponding to the lower part of the skier's leg.

SUMMARY OF THE INVENTION

The invention aims at overcoming these disadvantages by proposing a ski boot, of the type having a central and/or front entry, referred to as "variable volume ski boot", that is of extremely simplified construction, easy to put on and take off, easily adjusted on the lower part of the leg and the foot of the skier, and impervious. Likewise, the invention has the object of proposing such a boot that is laterally rigid for a good transmission of the skier's supports on the boot upper, and relatively flexible in the longitudinal direction thereof to elastically control the front and/or rear supports of the skier with respect to the displacement force and/or amplitude.

To this end, the invention relates to the extremely simplified production of an alpine ski boot obtained from a shell base provided with an external sole and topped by an upper provided with a central and/or anterior opening for the passage of the skier's foot, which forms, at its upper portion, a collar adapted to encircle the lower portion of the leg by means of at least one tensioning member arranged on transverse flaps, obtained on both sides of the opening of the upper and adapted to cooperate by mutual overlapping, during closure, under the effect of the tensioning member. The ski boot is composed of two main parts that are constituted, on the one hand, by the shell base open longitudinally at its upper portion and obtained in a relatively rigid material and, on the other hand, by a single opening-closure element attached and fixed on the periphery of the upper longitudinal opening of the shell base, this element itself having, all in one piece, a first substantially vertical portion forming the upper that encircles the lower part of the leg by means of the collar, and a substantially horizontal second portion obtained in the extension of the first and forming an upper cuff for holding the foot, the assembly thus formed being obtained in a relatively less rigid material than that of the shell base.

The present invention is also related to the characteristics that will become apparent from the description that follows, and that must be considered separately, or according to all of their possible technical combinations.

BRIEF DESCRIPTION OF DRAWINGS

This description, which is provided by way a non-limiting example, will help to better understand how the invention can be obtained, with reference to the annexed drawings, in which:

FIG. 1 is a lateral view of a boot according to the invention;

FIG. 2 is a perspective view of the portion of the boot that constitutes an element for covering and closing the lower shell base (not shown);

DETAILED DESCRIPTION OF THE PREFERRED EMBODIMENTS

Figure 4:
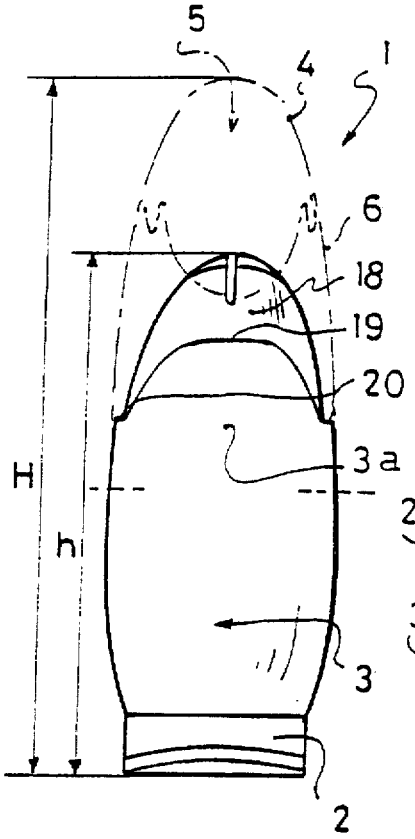
FIG. 4 is a rear view of the boot according to FIG. 3.

In a general manner, the boot 1, shown entirely in FIG. 1, has an external sole 2 and a shell base 3 topped by an upper 4 provided, at its upper portion, with a central and/or anterior opening 5 to allow for the passage of the skier's foot. The upper 4 forms, in this upper portion, a collar that is adapted to encircle the lower part of the leg by means of at least one tensioning member 7 arranged on transverse flaps, namely, 10*c*, 10*d*, 10*e*, that are described more in detail hereinafter.

According to the present example of embodiment, the opening of the upper 4 occurs at the front of the boot 1, but, of course, the invention is not limited thereto.

Therefore, the flaps are provided on both sides of the frontal opening of the upper 4 and are adapted to cooperate by mutual overlapping, during closure, under the effect of the tensioning members 7.

In fact, the boot, according to the invention, is composed of two main parts that are constituted, on the one hand, by the shell base 3 with a longitudinal opening 11 at its upper portion, obtained in a relatively rigid material and, on the other hand, by a single covering-closing element 12 attached and fixed on the periphery 11*a* of the upper longitudinal opening 11 of the shell base 3, this element 12 itself having, all in one piece, a first substantially vertical portion forming the upper 4 that encircles the lower part of the leg by means of the collar 6, and a substantially horizontal second portion 13 obtained in the extension of the first and forming an upper cuff for holding the foot, the assembly thus formed being obtained in a relatively less rigid material than that of the shell base 3.

Furthermore, the portion 13 of the covering-closing element 12 forming the upper cuff for holding the foot covers the corresponding longitudinal opening 11 of the shell base 3 by forming at least two adjacent transverse flaps, namely, 10*a*, 10*b*, arranged on both sides of the longitudinal axis of the shell base 3 and provided with a plurality of tensioning members 7 facing each other and acting on the flaps in the transverse direction.

Preferably, the longitudinal opening 11 of the shell base 3 extends over almost the entire length thereof from a front zone that is close to its tip 14 and along a width that determines a large opening for the entry of the foot.

This has the advantage of facilitating the putting on and taking off of the boot due to a substantial clearance in the area of the skier's instep.

More specifically, the transverse flaps of the covering element 12, namely 10*a* and 10*b*, overlap one another and extend in the extension of one another, at least in the zone of the upper cuff 13 for holding the foot, by forming a fold or pleat 15 therebetween, in the manner of a bellows, to ensure a permanent imperviousness of the boot 1, including when the flaps 10*a* and 10*b* are spaced apart to allow for the passage of the foot when putting on or taking off the boot.

On the contrary, but not necessarily, the transverse flaps 10*c*, 10*d*, 10*e* of the collar 6 are obtained by distinct cutting and mutually overlap one another at the level of their free edges directed to the longitudinal axis of the opening 5, at least in the upper zone of the upper 4.

As shown particularly in FIG. 2, the flaps 10*c* and 10*d* are arranged on the same side of the collar 6 and are adapted to cooperate with a single flap 10*e* located on the other side.

According to a characteristic of the invention, the covering-closing element 12 forming both the upper 4 and the upper cuff 13 for holding the foot is attached and fixed on the periphery 11*a* of the upper longitudinal opening 11 of the shell base 3, by means of binding points 16 that are capable of connecting two superposed peripheral linkage zones A and B to one another, and constituting the lower periphery of the covering-closing element 12 and the upper periphery of the shell base 3, respectively.

It must be noted that these linkage zones A and B have the particularity of being relatively thinner than the covering-closing element 12 and the shell base 3 themselves which, in addition, have a different rigidity, as already mentioned hereinabove.

The binding points 16 of the covering-closing element 12, with respect to the shell base 3, are preferably arranged on the anterior periphery of the horizontal portion of the element forming the upper cuff 13 for holding the foot, from two journal axes 17 located at the level of the malleoli of the skier's foot in order to permit their relative pivoting in relation to one another, by an effect of elastic flexibility of the upper 4 with respect to the upper cuff 13 for holding the foot, the posterior zone thereof extending beyond the journal axes 17 and being short of binding points 16 with respect to the shell base 3.

According to the present example, the binding points 16 are constituted by rivets, but they could be replaced by any other known assembly means such as, for example, a gluing of the zones A and B, respectively, in an equally anterior portion of the peripheries of the element 12 and of the opening 11 of the shell base 3, from the same journal axes 17. In the broadest sense, zones A and B are connected by a fixed attachment means, whether constitued by the aforementioned binding points or otherwise.

According to another characteristic of the invention, the shell base is extended, at its posterior end 3*a*, corresponding to its heel, by a relatively rigid vertical extension 18 extending above the skier's ankle towards the base of his calf, over a height h corresponding substantially to two thirds of the total height H of the boot 1, while covering, at least partially, the lateral zones of the skier's malleoli.

Thus, one can say, in a general manner, that the boot 1 is constituted of two thirds of rigid portion (the shell base 3) and of one third of flexible portion (the collar 6).

An optimum lateral rigidity is thus obtained because the upper 4, blocked on the rigid extension 18 at the level of its journal axis 17, overlaps the latter up to its posterior end above the heel.

Advantageously, the posterior vertical end 18 of the shell base 3 comprises a rear support portion or element 19 located in the longitudinal axis of the boot 1 and capable of cooperating with a corresponding engagement portion of the part forming the upper 4 of the covering-closing element 12 pivotably mounted on the shell base 3. The upper 4 is thus blocked rearwardly and it offers a firm support to the skier for his or her front-to-rear equilibrium. To improve the quality of this support, the posterior vertical extension 18 of the shell base 3 preferably comprises two lateral support edges 20 extending behind the pivoting axes 17 and capable of cooperating with corresponding portions of the upper 4 to thereby define a rearward support position of the collar 6 with respect to the shell base.

Figure 3:
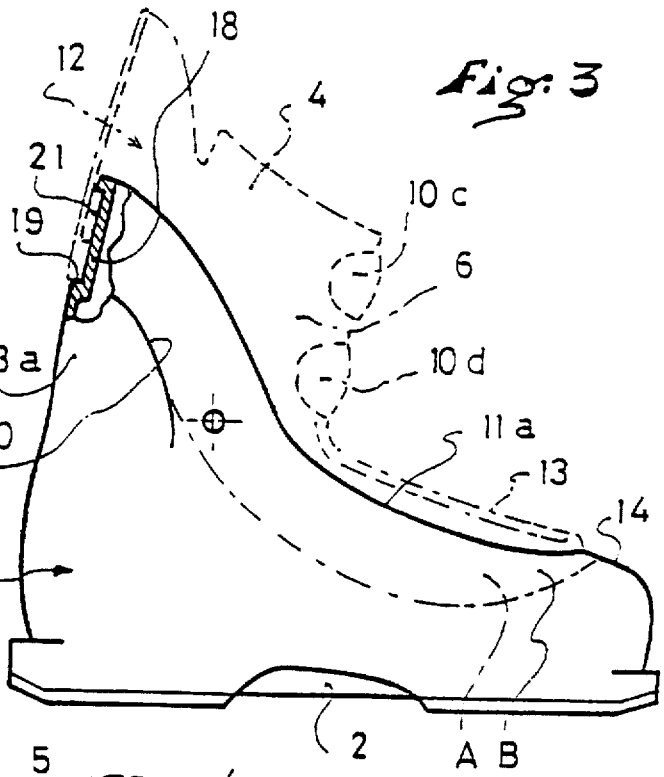
FIG. 3 is a lateral view of the shell base according to the invention.
Figure 5:
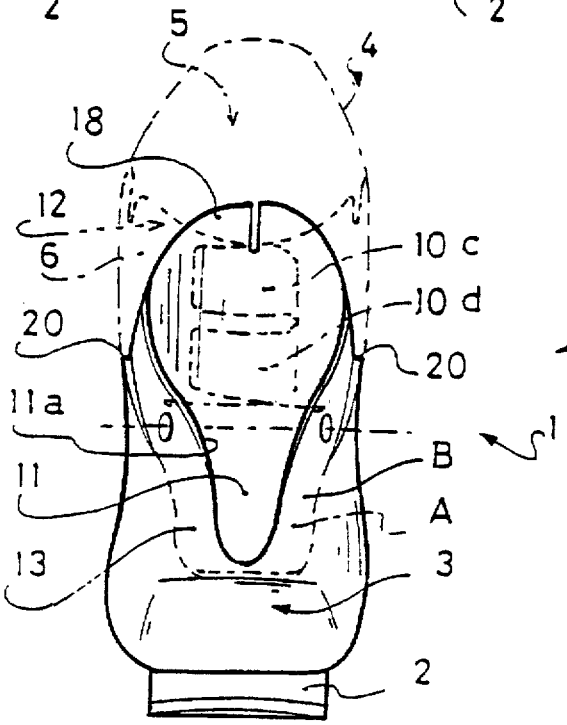
FIG. 5 is a front view of the boot according to FIG. 3.

As shown in FIG. 3, the boot 1 can also be provided with means 21 for limiting the amplitude of the possible pivoting of the upper 4 with respect to the shell base 3 and to the upper cuff 13 for holding the foot. These means 21 make it possible to control the movement of the upper 4 and, therefore, the possibility of rear-to-front flexion of the skier's leg.

Other known means for rear support and for controlling the flexion can be used and equipped with adjustment elements capable of modifying the initial rear support position of the upper 4 with respect to the shell base 3 and/or the amplitude of the movement permitted.

Furthermore, elastically deformable devices or members, for example, can be coupled to the upper 4 and to the shell base 3 in order to vary, as required, the intensity of the forces resisting the flexion of the upper.

The instant application is based upon French Patent Application No. 95.10584, filed on Sep. 6, 1995, the disclosure of which is hereby expressly incorporated by reference thereto in its entirety and the priority of which is claimed under 35 USC 119.

What is claimed is:

1. An alpine ski boot comprising:

(a) two primary parts, said two primary parts constituting:

(1) a shell base having a length extending from a rear end to a forward tip, said shell base including an external sole, said shell base further including a longitudinally extending opening in an upper portion of said shell base, said shell base opening being defined by a periphery extending along substantially the entirety of said length of said shell base, said shell base being made of a relatively rigid material; and (2) a one-piece covering-closing element positioned upon said shell base, said covering-closing element being made of a material less rigid than said relatively rigid material of said shell base, said covering-closing element comprising:

(A) a substantially vertical first upper portion comprising a collar adapted to encircle a lower leg of a skier, said first portion comprising an upper opening for receiving a skier's foot, said upper opening being one of a central opening and a front opening, said collar comprising at least one transverse flap on each lateral side of said upper opening; and (B) a substantially horizontal second upper portion comprising an upper cuff adapted to hold a foot of a skier, said upper cuff covering said longitudinally extending opening of said shell base and being fixedly attached on said periphery of said shell base opening, said upper cuff further comprising mutually overlapping transverse flaps on respective sides of a longitudinal plane of the boot, thereby forming a pleat;

said covering-closing element, forming both said collar and said upper cuff, being fixedly attached to said shell base by means of binding points attaching a lower periphery of said covering-closing element and an upper periphery of said shell base;

said covering-closing element being affixed to said shell base by means of a pair of laterally spaced journals located in an area of a skier's malleoli for enabling relative pivoting between said collar and said shell base, said collar being pivotal with respect to said upper cuff by means of elastic flexibility of said collar with respect to said upper cuff;

said binding points being arranged on a periphery of said upper cuff forward of said journals, there being no binding points rearward of said journals (b) at least one tensioning member positioned upon a pair of said transverse flaps of said collar, extending from said respective ones of said lateral sides of said upper opening for causing said transverse flaps to mutually overlap during closure of said collar by application of a tensioning force by said at least one tensioning member;

(c) a plurality of tensioning members positioned upon mutually overlapping respective pairs of said transverse flaps of said upper cuff, said tensioning members being adapted to apply a transversely directed tensioning force.

2. A ski boot according to claim 1, wherein:

each of said transverse flaps of said collar has a free edge, each free edge of one of said transverse flaps of said collar overlapping a transverse flap of said collar on a respective opposite lateral side of said upper opening.

3. A ski boot according to claim 1, wherein:

said shell base further comprises a relatively rigid rear vertical extension at a rear end of said shell base, said extension extending to a position above a skier's ankle towards a base of a calf of a skier, over a height substantially equal to two-thirds the height of the boot, said extension at least partially covering lateral portions of a skier's malleoli.

4. A ski boot according to claim 3, wherein:

said rear vertical extension of said shell base comprises a rear support portion located along said longitudinal plane of the boot; and said collar of said covering-closing element comprises an engagement portion for engagement with said rear support portion of said shell base for facilitating blocking of said covering-closing element in rear supporting engagement with respect to said shell base.

5. A ski boot according to claim 1, further comprising:

means for limiting amplitude of forward movement of said collar with respect to said upper cuff.

6. A ski boot according to claim 5, wherein:

said means for limiting comprises mutually abutting surfaces of said collar and said shell base.

7. A ski boot according to claim 1, wherein:

said shell base is a one-piece shell base.

8. An alpine ski boot comprising:

(a) two primary parts, said two primary parts constituting:

(1) a shell base, said shell base including an external sole, said shell base further including a longitudinally extending opening in an upper portion defined by a periphery, said shell base being made of a relatively rigid material; and (2) a one-piece covering-closing element positioned upon said shell base, said covering-closing element having an opening for receiving a skier's foot, said opening being one of a central opening and front opening, said covering-closing element further comprising at least one transverse flap on each lateral side of said opening, said covering-closing element being secured on said periphery of said opening of said shell base by a fixed attachment means, said covering-closing element being made of a material less rigid than said relatively rigid material of said one-piece shell base, said covering-closing element having a lower periphery superposed with an upper periphery of said shell base, said superposed peripheries being fixedly attached together, said covering-closing element further comprising:

(A) a substantially vertical first portion comprising a collar adapted to encircle a lower leg of a skier; and (B) a substantially horizontal second portion comprising an upper cuff adapted to hold the foot of a skier;

(b) at least one tensioning member positioned upon a pair of said transverse flaps of said collar, extending from said respective ones of said lateral sides of said upper opening for causing said transverse flaps to mutually overlap during closure of said collar by application of a tensioning force by said at least one tensioning member; and (c) laterally spaced journals affixing said covering-closing element to said shell base located in an area of a skier's malleoli for enabling relative pivoting between said collar and said shell base, said collar being pivotal with respect to said upper cuff by means of elastic flexibility of said collar with respect to said upper cuff, said fixed attachment means between said covering-closing element and said shell base is located only forward of said journals.

9. A ski boot according to claim 8, wherein:

said shell base further comprises a relatively rigid rear vertical extension at a rear end of said shell base, said extension extending to a position above a skier's ankle towards a base of a calf of a skier, over a height substantially equal to two-thirds the height of the boot, said extension at least partially covering lateral portions of a skier's malleoli.

10. A ski boot according to claim 9, wherein:

said rear vertical extension of said shell base comprises a rear support portion located along a longitudinal plane of the boot; and said collar of said covering-closing element comprises an engagement portion for engagement with said rear support portion of said shell base for facilitating blocking of said covering-closing element in rear supporting engagement with respect to said shell base.

11. A ski boot according to claim 9, wherein:

said covering-closing element is affixed to said shell base by means of a pair of laterally spaced journals located in an area of a skier's malleoli for enabling relative pivoting between said collar and said shell base;

said rear vertical extension of said shell base comprises two lateral support edges rearward of said journals; and said collar comprises engagement portions, said engagement portions being positioned for supporting engagement with said support edges of said rear vertical extension of said shell base to define a rearward support position of said collar.

12. A ski boot according to claim 8, further comprising:

means for limiting an amplitude of forward movement of said collar with respect to said upper cuff.

13. A ski boot according to claim 12, wherein:

said means for limiting comprises mutually abutting surfaces of said collar and said shell base.

14. A ski boot according to claim 8, wherein:

said upper cuff further comprises mutually overlapping transverse flaps on respective sides of a longitudinal plane of the boot, thereby forming a pleat to render said boot impervious, including during a spacing apart of said transverse flaps of said upper cuff as the foot of a skier is being inserted or removed from the boot.

15. A ski boot according to claim 8, wherein:

said shell base opening is defined by a periphery extending longitudinally along substantially the entirety of said shell base.

16. A ski boot according to claim 8, wherein:

said shell base is a one-piece shell base.

17. An alpine ski boot comprising:

(a) two primary parts, said two primary parts constituting:

(1) a shell base having a length extending from a rear end to a forward tip, said shell base including an external sole, said shell base further including a longitudinally extending opening in an upper portion of said shell base, said shell base opening being defined by a periphery extending along substantially the entirety of said length of said shell base, said shell base being made of a relatively rigid material and further comprising a relatively rigid rear vertical extension at a rear end of said shell base, said extension extending to a position above a skier's ankle towards a base of a calf of a skier, over a height substantially equal to two-thirds the height of the boot, said extension at least partially covering lateral portions of a skier's malleoli, said rear vertical extension of said shell base comprising two lateral support edges rearward of said journals; and (2) a one-piece covering-closing element positioned upon said shell base, said covering-closing element being made of a material less rigid than said relatively rigid material of said shell base, said covering-closing element comprising:

(A) a substantially vertical first upper portion comprising a collar adapted to encircle a lower leg of a skier, said first portion comprising an upper opening for receiving a skier's foot, said upper opening being one of a central opening and a front opening, said collar comprising at least one transverse flap on each lateral side of said upper opening, said collar comprising engagement portions, said engagement portions being positioned for supporting engagement with said support edges of said rear vertical extension of said shell base to define a rearward support position of said collar; and (B) a substantially horizontal second upper portion comprising an upper cuff adapted to hold a foot of a skier, said upper cuff covering said longitudinally extending opening of said shell base and being fixedly attached on said periphery of said shell base opening, said upper cuff further comprising mutually overlapping transverse flaps on respective sides of a longitudinal plane of the boot, thereby forming a pleat;

said covering-closing element being affixed to said shell base by means of a pair of laterally spaced journals located in an area of a skier's malleoli for enabling relative pivoting between said collar and said shell base;

(b) at least one tensioning member positioned upon a pair of said transverse flaps of said collar, extending from said respective ones of said lateral sides of said upper opening for causing said transverse flaps to mutually overlap during closure of said collar by application of a tensioning force by said at least one tensioning member;

(c) a plurality of tensioning members positioned upon mutually overlapping respective pairs of said transverse flaps of said upper cuff, said tensioning members being adapted to apply a transversely directed tensioning force.

18. A ski boot according to claim 17, wherein:

each of said transverse flaps of said collar has a free edge, each free edge of one of said transverse flaps of said collar overlapping a transverse flap of said collar on a respective opposite lateral side of said upper opening.

19. A ski boot according to claim 17, further comprising:

means for limiting an amplitude of forward movement of said collar with respect to said upper cuff.

20. A ski boot according to claim 19, wherein:

said means for limiting comprises mutually abutting surfaces of said collar and said shell base.

21. A ski boot according to claim 17, wherein:

said shell base is a one-piece shell base.

* * * * *